US005451271A

United States Patent [19]

Yoshida et al.

[11] Patent Number: 5,451,271

[45] Date of Patent: Sep. 19, 1995

[54] CONVERSION TREATMENT METHOD AND COMPOSITION FOR ALUMINUM AND ALUMINUM ALLOYS

[75] Inventors: Masayuki Yoshida; Kazuya Nakada, both of Kanagawa, Japan

[73] Assignee: Henkel Corporation, Plymouth Meeting, Pa.

[21] Appl. No.: 923,889

[22] PCT Filed: Feb. 13, 1991

[86] PCT No.: PCT/US91/00965

§ 371 Date: Aug. 20, 1993

§ 102(e) Date: Aug. 20, 1993

[87] PCT Pub. No.: WO91/13186

PCT Pub. Date: Sep. 5, 1991

[30] Foreign Application Priority Data

Feb. 21, 1990 [JP] Japan ..... 2-040168
Feb. 21, 1990 [JP] Japan ..... 2-040169

[51] Int. Cl.[6] ..... C23C 22/38

[52] U.S. Cl. ..... 148/247; 148/253; 148/258; 148/261; 148/268; 148/273; 148/275; 148/277; 148/284

[58] Field of Search ..... 148/247, 253, 258, 261, 148/268, 273, 275, 277, 284

[56] References Cited

U.S. PATENT DOCUMENTS 2,868,682 1/1959 Dell ..... 148/258
4,131,489 12/1978 Newhard, Jr. ..... 148/258

*Primary Examiner*—David A. Simmons
*Assistant Examiner*—Robert R. Koehler
*Attorney, Agent, or Firm*—Ernest G. Szoke; Wayne C. Jaeschke; Norvell E. Wisdom, Jr.

[57] ABSTRACT

The paint adhesion and corrosion resistance of surfaces of aluminum and its alloys, particularly when using a paint based on poly{vinyl chloride}, is improved by using a conversion coating solution having a pH in the range from 1.0 to 3.0 and consisting essentially of water and:

(A) an amount of phosphate ions that is stoichiometrically equivalent to at least 5.0 g/L of phosphoric acid;
(B) at least 1.0 g/L of hexavalent chromium;
(C) at least 0.1 g/L of fluoride ions; and
(D) a complex fluoride ion component selected from the group consisting of:
(i) at least 4.0 g/L of fluosilicate ions,
(ii) at least 0.5 g/L of fluoborate ions,
(iii) at least 2.0 g/L of fluozirconate ions, and
(iv) at least 2.0 g/L of fluotitanate ions.

15 Claims, No Drawings

CONVERSION TREATMENT METHOD AND COMPOSITION FOR ALUMINUM AND ALUMINUM ALLOYS

TECHNICAL FIELD

The present invention relates to a novel conversion treatment solution for aluminum and aluminum alloys which imparts an excellent corrosion resistance and paint adherence to the surface of aluminum and aluminum alloys prior to their being painted and to a process of treating surfaces with such a solution. The conversion treatment solution is particularly well suited for application to the surface of, for example, the lid material for beverage cans (i.e., can end stock) and the like.

BACKGROUND ART

Conversion treatment solutions for aluminum and aluminum alloys may be roughly classified into chromate-type treatments and nonchromate-type treatments. Typical examples of chromate-type treatments are chromic acid/chromate treatments and phosphoric acid/chromate treatments. Chromic acid/chromate treatments came into practical application in about 1950, and are still widely used at present on, for example, the fin material of heat exchangers. The principal components of this type of conversion treatment solution are chromic acid ($CrO_3$) and hydrofluoric acid (HF), and an accelerator may also be present. A film which contains some quantity of hexavalent chromium is formed.

The phosphoric acid/chromate conversion treatment is disclosed in U.S. Pat. No. 2,438,877. This conversion treatment solution is composed of chromic acid ($CrO_3$), phosphoric acid ($H_3PO_4$), and hydrofluoric acid (HF). The principal component of the resulting film is hydrated chromium phosphate ($CrPO_4.4H_2O$). Since this film does not contain much if any hexavalent chromium, it is widely used at present as a paint undercoating treatment for beverage cans and the associated lid stock.

Nonchromate-type treatments are recognized in the art as a distinct category from the chromate-type treatment solutions explained above, and are exemplified by the invention disclosed in Japanese Patent Application Laid Open [Kokai] Number 52-131937 [131,937/77]. The treatment solution disclosed therein comprises an acidic (pH approximately 1.0 to 4.0) aqueous coating solution which contains zirconium or titanium or a mixture thereof as well as phosphate and fluoride. Treatment with the disclosed conversion treatment solution produces on the aluminum surface a conversion film whose main component is zirconium and/or titanium oxide. Although the absence of hexavalent chromium is an advantage of the nonchromate-type treatment solution, this type of treatment solution nevertheless suffers from a corrosion resistance and paint adherence inferior to those for chromate-type treatments.

Aluminum alloy, in sheet or coil form, is widely used after painting for beverage can lid material, i.e., can end stock. It is subjected to a conversion treatment in order to raise the corrosion resistance and paint adherence, and the phosphoric acid/chromate treatment is employed in almost all commercial can lid manufacturing in Japan.

The phosphoric acid/chromate conversion treatment of can end stock generally employs a treatment solution which contains 10.0 to 40.0 g/L phosphate ion, 2.0 to 4.0 g/L hexavalent chromium, and 0.7 to 1.5 g/L fluoride ion. At present, vinyl chloride paint is generally used to coat can end stock. Thus, the production of can ends normally includes a phosphoric acid/chromate treatment of aluminum alloy in coil or sheet form, followed by coating with a vinyl chloride paint and then forming.

A beverage can thus normally consists of a can end formed from aluminum alloy coil or sheet treated as described above and of a can body filled with, for example, juice or beer. Depending on its contents, the can may be subjected to sterilization at relatively high temperatures after filling. If it is, steam is formed from vaporization of the contents, the steam penetrates through the paint film, and the permeated steam then condenses at the interface between the paint film and conversion film. As a result, sterilization tends to reduce the adherence of the paint film. In particular, when a section of the can end is opened by the easy-open method, defects (enamel feathering) can be generated in the opened region due to peeling or exfoliation of the paint film.

DESCRIPTION OF THE INVENTION

Problem to Be Solved by the Invention

Increasing the adhesion of paint to aluminum and its alloys, particularly aluminum and its alloys used in forming beverage can ends to be used for cans requiring high temperature sterilization of the contents, is the major problem addressed by this invention.

Summary of the Invention

As a concrete means for solving the problems described hereinbefore for the prior art, the present invention introduces an aqueous conversion treatment solution for aluminum and aluminum alloys which is characterized in that its pH is in the range from 1.0 to 3.0 and in that it comprises, or preferably consists essentially of, water and at least 5.0 grams per liter ("g/L") of phosphate ions, at least 1.0 g/L of hexavalent chromium (in the form of chromium containing anions), at least 0.1 g/L of fluoride ions, and a complex fluoride ion component selected from the group consisting of (i) at least 4.0 g/L of fluosilicate ion, (ii) at least 0.5 g/L of fluoborate ion, (iii) at least 2.0 g/L of fluozirconate ions, and (iv) at least 2.0 g/L of fluotitanate ions. This conversion treatment solution is capable of forming a highly paint-adherent conversion film which imparts an excellent corrosion resistance to the surface of aluminum and aluminum alloys. In other words, the present invention seeks to offer a conversion treatment solution which imparts an excellent corrosion resistance and paint adherence to the surface of aluminum and aluminum alloy prior to their being painted.

Details of Preferred Embodiments of the Invention

The conversion treatment solution of the present invention is an acidic treatment solution which contains complex fluoride ion, phosphate ion, hexavalent chromium, and fluoride ion as its essential components.

The complex fluoride ions are selected from fluosilicate ($SiF_6^{-2}$) ions, fluotitanate ($TiF_6^{-2}$), fluozirconate ($ZrF_6^{-2}$), and fluoborate ($BF_4^{-2}$) ions, and may be added in the form of fluosilicic acid, fluoboric acid, fluozirconic acid, fluotitanic acid, or any soluble salt thereof. Mixtures of these ions may also be used. A range of 4.0 to 15.0 g/L is preferred for the fluosilicate ion. Values less than 4.0 g/L cannot normally generate good paint adherence, while values exceeding 15.0 g/L may cause substantial etching of an aluminum surface and prevent the formation of a satisfactory film. A range of 0.5 to 3.0 g/L is preferred for the fluoborate ion. Values less than 0.5 g/L again cannot usually generate a good paint adherence, while values in excess of 3.0 g/L increase waste water pollution and are uneconomical. A range of 2.0 to 8.0 g/L is preferred for fluozirconate ions, fluotitanate ions, or mixtures of these two ions. Concentrations of these two complex fluoride ions that are less than 2.0 g/L cannot usually generate good paint adherence, while concentrations exceeding 8.0 g/L cause substantial etching and usually prevent the formation of a satisfactory film.

Phosphoric acid ($H_3PO_4$) is the preferred source for the phosphate ion, and the preferred phosphoric acid content falls into the range of 5.0 to 40.0 g/L. When this value is less than 5.0 g/L, the resulting film will normally contain only small quantities of chromium phosphate and the paint adherence may be inadequate. While good films are formed at concentrations exceeding 40.0 g/L, the cost of the treatment solution is also increased and the economics become less favorable.

Chromic acid ($CrO_3$) is the preferred source for the hexavalent chromium, and the preferred chromic acid content is that which will result in a concentration of its stoichiometric equivalent as hexavalent chromium in the range from 1.0 to 4.0 g/L. Values less than 1 g/L result in an inferior corrosion resistance because a satisfactory conversion film is not formed. Values in excess of 4.0 g/L can cause increased pollution from and/or pollution abatement cost for waste water from the treatment solution and thus create environmental and economic problems.

The fluoride ion content is an important component for controlling the film growth rate of the conversion film. The fluoride ion source may be, for example, hydrofluoric acid (HF), sodium fluoride (NaF), potassium fluoride (KF), and the like. The fluoride ion concentration in the conversion solutions was determined as follows: An ion-selective electrode (Fluorine F-125 electrode, reference HS-305DP from Toa Denpa Kogyo Kabushiki Kaisha) and an ion meter (Type IM-40S from Toa Denpa Kogyo Kabushiki Kaisha) were used. For calibration, standard solutions were prepared by adding a specified quantity of hydrofluoric acid (for example, 0.1 g/L, 1 g/L, or 10 g/L) to 5 g/L chromic acid and 15 g/L phosphoric acid and by adjusting the pH to 2.0 with phosphoric acid or sodium hydroxide. (The fluoride ion concentration was assumed to correspond to the total quantity of fluorine from hydrofluoric acid addition). The meter readings obtained with these solutions of known fluoride ion concentration were then determined and plotted against the fluoride ion concentrations to generate a calibration curve. The pH of the conversion solution itself was adjusted to 2.0 using phosphoric acid or sodium hydroxide and then measured using the fluorine ion meter, and the measured value was converted to the fluoride ion concentration by reference to the calibration curve.

The preferred range for the fluoride ion concentration is 0.1 to 2.0 g/L. At values less than 0.1 g/L, the growth rate of the conversion film is slow, so that long treatment times must be used in order to obtain satisfactory conversion films and the productivity is therefore low. Rapid growth rates are encountered at values in excess of 2.0 g/L; this results in large film weights and an undesirable loss of the metallic luster of the workpiece. As a consequences the preferred concentration range is 0.1 to 2.0 g/L; the particularly preferred range is 0.4 to 1.0 g/L.

The pH of this conversion treatment solution should be in the range of 1.0 to 3.0 and may conveniently be adjusted into that range through the use of an acid arbitrarily selected from acids such as phosphoric acid, nitric acid, and hydrochloric acid or a base arbitrarily selected from bases such as sodium hydroxide, ammonium hydroxide, and the like. A pH below 1.0 causes substantial etching and therefore interferes with coat formation. A pH in excess of 3.0 usually results in weak etching so that a uniform film cannot be formed.

The use of the conversion treatment solution of the present invention in treatment processes is another embodiment of this invention and will now be considered in more detail. The conversion treatment solution of the present invention can be used as a substitute for the currently widely used phosphoric acid/chromate treatment solutions. A preliminary surface cleaning must usually be carried out when the conversion treatment solution of the present invention is used for the conversion treatment of the surface of aluminum or aluminum alloy. The cleaning method in this case may consist of treatment with an acidic, alkaline, or solvent-based cleaning solution or some combination thereof. As necessary or desired, the aluminum or aluminum alloy surface may be etched with alkali or acid after cleaning. Either immersion or spray treatment may be used as the method for treatment with solution according to the present invention. The weight of the resulting conversion film is governed by such factors as the treatment temperature and treatment time. The temperature of the treatment solution should preferably fall into the range from room temperature (about 20 degrees Centigrade) to 70 degrees Centigrade and more preferably falls into the range from 35 to 55 degrees Centigrade. Treatment times in the range of 1 to 90 seconds are preferred. As with phosphoric acid/chromate films, the conversion film weight is normally evaluated based on the deposition of chromium, zirconium, and/or titanium. The quantity of deposition of each of the three metals, when present at all, preferably falls within the range of 5 to 50 $mg/m^2$, and should be adjusted in accordance with the required degree of corrosion resistance. The deposition of chromium, titanium, and/or zirconium can be controlled by suitably adjusting the treatment temperature and treatment time.

The conversion film formed by the conversion treatment solution according to the present invention when neither zirconium or titanium is present is believed to be chemically and physically similar to the film formed by phosphoric acid/chromate treatments, and is composed principally of hydrated chromium phosphate ($CrPO_4.4H_2O$). When either fluotitanate or fluozirconate is included in the treatment solution, the conversion film usually contains both hydrated chromium phosphate and zirconium oxide ($ZrO_2$) and/or titanium oxide ($TiO_2$).

EXAMPLES

The conversion treatment solution of the present invention is explained in greater detail below through the use of several illustrative examples. The first group of examples are for solutions containing fluoborate or fluosilicate ions, and the effectiveness of such solutions relative to comparison examples is reported in Table 1.

The substrate for these examples was an aluminum/magnesium alloy (described in detail in Japanese Industrial Standard {hereinafter "JIS"} A5082). This aluminum alloy was degreased and conversion treated using a small sprayer designed to give spraying conditions identical to those currently encountered in typical spray treatments on commercial continuous conversion treatment lines for the conversion treatment of aluminum alloy coil. Chromium content in the coating deposited by the conversion process was measured using a fluorescent X-ray analyzer (Model 3070E from

TABLE 1

RESULTS OF EVALUATION TESTING

| | Conversion Film Areal Density in mg of Cr/m$^2$ | Salt Spray Test Time, Hours | Peel Test Strength, Kg/5 mm | Alcoa Test Residual Width, mm |
|---|---|---|---|---|
| Example 1 | 20 | 2500 | 3.0 | 0.2 |
| Example 2 | 20 | 2500 | 3.2 | 0.3 |
| Example 3 | 15 | 2300 | 3.5 | 0.3 |
| Example 4 | 25 | 2800 | 3.6 | 0.2 |
| Example 5 | 20 | 2500 | 3.2 | 0.3 |
| Example 6 | 20 | 2500 | 3.2 | 0.3 |
| Example 7 | 20 | 2500 | 3.4 | 0.2 |
| Example 8 | 30 | 3000 | 3.4 | 0.2 |
| Comparison Example 1 | 20 | 2500 | 2.5 | 0.6 |
| Comparison Example 2 | 15 | 2000 | 2.5 | 0.7 |
| Comparison Example 3 | 20 | 2500 | 2.0 | 0.8 |
| Comparison Example 4 | 20* | 1700 | 1.3 | 1.0 |

*This figure is the areal density of Zr rather than Cr.

Rigaku Denki Kogyo). This conversion treated aluminum alloy sheet was then coated with a can end paint of a poly (vinyl chloride) type to give a paint film thickness of 12 to 14 micrometers, which was then baked at 200 degrees Centigrade for 10 minutes before the sheets were subjected to the other tests reported in Table 1.

Salt-spray testing was conducted in order to evaluate the corrosion resistance. Salt-spray testing was conducted in accordance with JIS Z-2371, and the value reported is the time required for the appearance of blistering at a cross form cut in the paint film on the painted test panel. Thus, longer times correspond to a better corrosion resistance. Spray times of 2000 hours or more are generally now rated as excellent.

The paint adherence was evaluated as follows The painted test sheet was cut into 5×150 millimeter (hereinafter "mm") size rectangular strips, which were then hot-press-bonded with polyamide film. The obtained test specimen was immersed in boiling deionized water for 3 hours, and the peel strength was then evaluated in a 180° peel test. High peel strength values correspond to a better paint adherence, and as a general rule a value of 3.0 kilograms of force (hereinafter "kgf") per 5 mm width is rated as excellent.

Enamel feathering was evaluated in accordance with the Alcoa method, as described on page 49 of the Lecture Notes from the 73rd Fall Meeting of Keikinzoku Gakkai [Institute of Light Metals of Japan]. This evaluation is based on the maximum residual paint film width after peeling. Thus, smaller residual paint film widths correspond to a more desirable smaller amount of enamel feathering, and as a general rule residual widths not exceeding 0.5 mm are rated as excellent.

EXAMPLE 1

The surface of the aluminum alloy was cleaned by rinsing with a hot (70 degrees Centigrade) 4% aqueous solution of a commercial strongly alkaline degreaser (FINE CLEANER TM 4418 from Nihon Parkerizing Company, Limited) and then with water. This was followed by spraying for 5 seconds with conversion treatment solution 1 heated to 50 degrees Centigrade, rinsing again with tap water, spraying with deionized water (specific resistance≧3,000,000 ohm-cm) for 10 seconds, and finally drying in a hot-air drying oven at 70 degrees Centigrade for 5 minutes. After drying, the conversion coated test panel was painted as described above, and the corrosion resistance, paint adherence, and enamel feathering were then evaluated. Conversion treatment solution 1 contained 18.8 g/L of 40% fluosilicic acid ($H_2SiF_6$)=7.4 g/L of $SiF_6^{2-}$; 21.3 g/L of 75% phosphoric acid ($H_3PO_4$)=15.5 g/L of $PO_43-$; 5.8 g/L of chromic acid ($CrO_3$)=3.0 g/L of $Cr^{6+}$; and 3.0 g/L of 20% hydrofluoric acid (HF)=0.6 g/L of $F^-$; the pH was adjusted to 2.0 with ammonium hydroxide after all the other ingredients had been added.

EXAMPLE 2

This was identical to Example 1, except that the Conversion treatment solution 2 used contained only 12.5 g/L of 40% fluosilicic acid=4.9 g/L of $SiF_6^{2-}$, rather than the larger amount in Conversion treatment solution 1.

EXAMPLE 3

This was identical to Example 2, except that (i) the Conversion treatment solution 3 used contained only 2.9 g/L of chromic acid=1.5 g/L of $Cr^{6+}$, rather than the larger amount in Conversion treatment solution 2 and (ii) the pH was adjusted to 1.5 with hydrochloric acid rather than to 2.0 with ammonium hydroxide as in Conversion treatment solution 2.

EXAMPLE 4

This was identical to Example 1, except that the Conversion treatment solution 4 used contained 5.0 g/L of 20% hydrofluoric acid=1.0 g/L of $F^-$, rather than the smaller amount in Conversion treatment solution 1.

EXAMPLE 5

This was identical to Example 1, except that the Conversion treatment solution 5 used contained 1.0 g/L of sodium fluoborate ($NaBF_4$)=0.8 g/L of $BF_4^-$, instead of the fluosilicic acid used in Conversion treatment solution 1.

EXAMPLE 6

This was identical to Example 5, except that (i) the Conversion treatment solution 6 used contained 2.0 g/L of sodium fluoborate ($NaBF_4$)=1.6 g/L of $BF_4^-$, rather than the smaller amount in Conversion treatment solution 5 and (ii) the pH was adjusted to 2.5 instead of 2.0.

EXAMPLE 7

This was identical to Example 1, except that the samples were spray treated for 10 seconds at 40 degrees Centigrade rather than for 5 seconds at 50 degrees Centigrade as in Example 1.

EXAMPLE 8

This was identical to Example 1, except that the sample were spray treated for 10 seconds rather than for 5 seconds as in Example 1.

COMPARISON EXAMPLE 1

This was identical to Example 1, except that the Conversion treatment solution 7 used contained only 6.3 g/L of 40% fluosilicic acid=2.5 g/L of $SiF_6^{2-}$, rather than the larger amount in Conversion treatment solution 1.

COMPARISON EXAMPLE 2

This was identical to Example 1, except that the Conversion treatment solution 8 used contained 40.0 g/L of 40% fluosilicic acid=15.8 g/L of $SiF_6^{2-}$, rather than the smaller amount in Conversion treatment solution 1.

COMPARISON EXAMPLE 3

The aluminum alloy was cleaned as in Example 1 and then spray-treated for 5 seconds with a 5% aqueous solution of a commercial phosphoric acid/chromate treatment concentrate (ALCHROM TM K702 from Nihon Parkerizing Company, Limited) heated to 50 degrees Centigrade. After this treatment, it was rinsed with water, dried, and painted as in Example 1, and its performance was then evaluated.

COMPARISON EXAMPLE 4

The aluminum alloy was cleaned as in Example 1 and then spray-treated for 30 seconds with a 2% aqueous solution of a commercial non-chromate treatment concentrate (PARCOAT TM K3761 from Nihon Parkerizing Company, Limited) heated to 50 degrees Centigrade. After this treatment, it was rinsed with water, dried, and painted as in Example 1, and its performance was then evaluated.

Another group of examples and comparison examples utilized solutions containing fluozirconate or fluotitanate ions, as described in more detail below.

EXAMPLE 9

This was identical to Example 1, except that the Conversion Solution 9 used contained 20.2 g/L of 20% aqueous fluozirconic acid ($H_2ZrF_6$) =4.0 g/L of $ZrF_6^{-2}$ instead of the fluosilicic acid used in Conversion Solution 1 in Example 1.

EXAMPLE 10

This was identical to Example 9, except that the Conversion Solution 10 used contained 12.6 g/L of 20% aqueous fluozirconic acid ($H_2ZrF_6$) =2.5 g/L of $ZrF_6^{-2}$ instead of the larger amount of fluozirconic acid used in Conversion Solution 9 in Example 9.

EXAMPLE 11

This was identical to Example 9, except that the Conversion Solution 11 used (i) contained 1.9 g/L of chromic acid =1.0 g/L of $Cr^{+6}$ instead of the larger amount of chromic acid in Conversion Solution 1 in Example 1 and (ii) had a pH of 1.5 achieved by adjustment with hydrochloric acid rather than a pH of 2.0 achieved by adjustment with ammonia as in Conversion Solution 9.

EXAMPLE 12

This was identical to Example 11, except that the Conversion Solution 11 used contained 5.8 g/L of chromic acid =3.0 g/L of $Cr^{+6}$ and 5.0 g/L of 20% aqueous hydrofluoric acid =1.0 g/L of $F^-$ ions instead of the smaller amounts of these two constituents used in Conversion Solution 11 in Example 11.

EXAMPLE 13

This was identical to Example 9, except that the Conversion Solution 13 used (i) contained 20.3 g/L of aqueous fluotitanic acid =4.0 g/L of $TiF_6^{-2}$ instead of the fluozirconic acid in Conversion Solution 9 in Example 9 and (ii) had a pH of 2.5 achieved by adjustment with sodium hydroxide rather than a pH of 2.0 achieved by adjustment with ammonia as in Conversion Solution 9.

EXAMPLE 14

This was identical to Example 9, except that the Conversion Solution 14 used contained 12.7 g/L of 20% aqueous fluotitanic acid =1.6 g/L of $TiF_6^{-2}$ and 12.6 g/L of 20% aqueous fluozirconic acid =2.5 g/L of $ZrF_6-$ ions instead of the larger amount of fluozirconic acid, with no fluotitanic acid, used in Conversion Solution 9 in Example 9.

EXAMPLE 15

This was identical to Example 9, except that the samples were spray treated for 10 seconds at 40 degrees Centigrade rather than for 5 seconds at 50 degrees Centigrade as in Example 9.

EXAMPLE 16

This was identical to Example 9, except that the samples were spray treated for 10 seconds rather than for 5 seconds as in Example 9.

COMPARISON EXAMPLE 5

This was identical to Example 9, except that the Conversion treatment solution 15 used contained only 5.0 g/L of 20% fluozirconic acid =1.0 g/L of $ZrF_6^{2-}$, rather than the larger amount in Conversion treatment solution 9.

COMPARISON EXAMPLE 6

This was identical to Example 9, except that the Conversion treatment solution 16 used contained 50.0 g/L of 20% fluozirconic acid =15.8 g/L of $ZrF_6^{2-}$, rather than the smaller amount of fluozirconic acid in Conversion treatment solution 9.

Test results from this second group of examples are shown in Table 2, where Comparison Examples 3 and 4 are repeated from Table 1.

BENEFIT OF THE INVENTION

As Tables 1 and 2 make clear, application of the conversion treatment solution of the present invention affords an excellent corrosion resistance and paint adherence as well as an excellent resistance enamel feathering.

TABLE 2

RESULTS OF TESTING WITH FLUOZIRCONATE AND FLUOTITANATE CONTAINING SOLUTIONS

| | Areal Density in Conversion Film of: | | | Salt Spray Test Time, Hours | Peel Test Strength, Kg Force/ 5 mm width | Alcoa Test Residual Width, mm |
|---|---|---|---|---|---|---|
| | Cr | Zr | Ti | | | |
| Example 9 | 20 | 20 | — | 2500 | 3.8 | 0.2 |
| Example 10 | 20 | 15 | — | 2500 | 3.3 | 0.3 |

TABLE 2-continued

RESULTS OF TESTING WITH FLUOZIRCONATE AND FLUOTITANATE CONTAINING SOLUTIONS

| | Areal Density in Conversion Film of: | | | Salt Spray Test Time, | Peel Test Strength, Kg Force/ | Alcoa Test Residual |
|---|---|---|---|---|---|---|
| | Cr | Zr | Ti | Hours | 5 mm width | Width, mm |
| Example 11 | 15 | 20 | — | 2500 | 3.4 | 0.3 |
| Example 12 | 25 | 25 | — | 2800 | 3.5 | 0.2 |
| Example 13 | 20 | — | 20 | 2500 | 3.3 | 0.3 |
| Example 14 | 20 | 15 | 15 | 2800 | 3.2 | 0.3 |
| Example 15 | 20 | 20 | — | 2500 | 3.5 | 0.2 |
| Example 16 | 30 | 30 | — | 3000 | 3.5 | 0.2 |
| Comparison Example 5 | 20 | 10 | — | 2500 | 2.5 | 0.6 |
| Comparison Example 6 | 15 | 15 | — | 2000 | 2.5 | 0.7 |
| Comparison Example 3 | 20 | — | — | 2500 | 2.0 | 0.8 |
| Comparison Example 4 | — | 20 | — | 1700 | 1.3 | 1.0 |

The invention claimed is:

1. An aqueous conversion coating solution that has a pH value from 1.0 to 3.0 and consists essentially of:

(A) an amount of phosphate ions that is stoichiometrically equivalent to at least 5.0 g/L of phosphoric acid;

(B) at least 1.0 g/L of hexavalent chromium;

(C) at least 0.1 g/L of fluoride ions; and (D) a complex fluoride ion component selected from the group consisting of:

(i) at least 4.0 g/L of fluosilicate ions, (ii) at least 0.5 g/L of fluoborate ions, (iii) at least 2.0 g/L of fluozirconate ions, and (iv) at least 2.0 g/L of fluotitanate ions.

2. An aqueous solution according to claim 1, which comprises from 0.4 to 1.0 g/L of fluoride ions.

3. An aqueous solution according to claim 1, consisting essentially of:

(A) an amount of phosphate ions that is stoichiometrically equivalent to from 5.0 to 40.0 g/L of phosphoric acid;

(B) from 1.0 to 4.0 g/L of hexavalent chromium;

(C) from 0.1 to 2.0 g/L of fluoride ions; and (D) a complex fluoride ion component selected from the group consisting of:

(i) from 4.0 to 15.0 g/L of fluosilicate ions, (ii) from 0.5 to 3.0 g/L of fluoborate ions, (iii) from 2.0 to 8.0 g/L of fluozirconate ions, and (iv) from 2.0 to 8.0 g/L of fluotitanate ions.

4. A process for treating a surface of aluminum or an aluminum alloy, said process comprising steps of forming a conversion coating on said surface and subsequently overcoating the conversion coated surface with an organic protective coating, wherein the conversion coating on said surface is formed by contacting said surface with an aqueous solution having a pH value from 1.0 to 3.0 and consisting essentially of:

(A) an amount of phosphate ions that is stoichiometrically equivalent to from 5.0 to 40.0 g/L of phosphoric acid;

(B) from 1.0 to 4.0 g/L of hexavalent chromium;

(C) from 0.1 to 2.0 g/L of fluoride ions; and (D) a complex fluoride ion component selected from the group consisting of:

(i) from 4.0 to 15.0 g/L of fluosilicate ions, (ii) from 0.5 to 3.0 g/L of fluoborate ions, (iii) from 2.0 to 8.0 g/L of fluozirconate ions, and (iv) from 2.0 to 8.0 g/L of fluotitanate ions.

5. A process according to claim 4, wherein said aqueous solution comprises from 0.4 to 1.0 g/L of fluoride ions.

6. A process according to claim 5, wherein the conversion coating formed contains from 5 to 50 milligrams per square meter of atoms selected from the group consisting of chromium, zirconium, and titanium atoms.

7. A process according to claim 4, wherein the conversion coating formed contains from 5 to 50 milligrams per square meter of atoms selected from the group consisting of chromium, zirconium, and titanium atoms.

8. A process according to claim 7, wherein the conversion coating is performed at a temperature in the range from 20 to 70 degrees Centigrade.

9. A process according to claim 6, wherein the conversion coating is performed at a temperature in the range from 20 to 70 degrees Centigrade.

10. A process according to claim 5, wherein the conversion coating is performed at a temperature in the range from 20 to 70 degrees Centigrade.

11. A process according to claim 4, wherein the conversion coating is performed at a temperature in the range from 20 to 70 degrees Centigrade.

12. A process according to claim 11, wherein the conversion coating is performed at a temperature in the range from 35 to 55 degrees Centigrade for a contact time in the range from 1 to 90 seconds.

13. A process according to claim 10, wherein the conversion coating is performed at a temperature in the range from 35 to 55 degrees Centigrade for a contact time in the range from 1 to 90 seconds.

14. A process according to claim 9, wherein the conversion coating is performed at a temperature in the range from 35 to 55 degrees Centigrade for a contact time in the range from 1 to 90 seconds.

15. A process according to claim 8, wherein the conversion coating is performed at a temperature in the range from 35 to 55 degrees Centigrade for a contact time in the range from 1 to 90 seconds.

* * * * *

UNITED STATES PATENT AND TRADEMARK OFFICE

CERTIFICATE OF CORRECTION

PATENT NO. : 5,451,271

DATED : Sep. 19, 1995

INVENTOR(S) : Masayuki Yoshida, Kazuya Nakada

It is certified that error appears in the above-indentified patent and that said Letters Patent is hereby corrected as shown below:

In col. 5, table 1, Example 1, delete [3.0] and insert --3.6--.

Signed and Sealed this

Eighth Day of October, 1996

*Attest:*

*Attesting Officer*

BRUCE LEHMAN

*Commissioner of Patents and Trademarks*